US012207710B2

(12) United States Patent
Tung et al.

(10) Patent No.: US 12,207,710 B2
(45) Date of Patent: Jan. 28, 2025

(54) FASTENER STRINGER, SLIDE FASTENER, AND METHOD FOR PRODUCING STOPPER COMPONENT AND SLIDE FASTENER

(71) Applicant: YKK Corporation, Tokyo (JP)

(72) Inventors: Yuchen Tung, Toyama (JP); Kazuo Tamura, Toyama (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 18/036,582

(22) PCT Filed: Dec. 24, 2020

(86) PCT No.: PCT/JP2020/048593

§ 371 (c)(1),
(2) Date: May 11, 2023

(87) PCT Pub. No.: WO2022/137471

PCT Pub. Date: Jun. 30, 2022

(65) Prior Publication Data

US 2023/0404222 A1 Dec. 21, 2023

(51) Int. Cl.
*A44B 19/38* (2006.01)

(52) U.S. Cl.
CPC ..... *A44B 19/384* (2013.01); *A44D 2203/00* (2013.01)

(58) Field of Classification Search
CPC .. A44B 19/384; A44B 19/38; A44D 2203/00; Y10T 24/2593
See application file for complete search history.

(56) References Cited

U.S. PATENT DOCUMENTS 7,036,192 B2 * 5/2006 Yoneoka ..... A44B 19/38 24/443
7,320,158 B2 * 1/2008 Deto ..... A41F 1/002 24/433
9,027,210 B2 * 5/2015 Peters ..... A44B 19/388 24/433
10,292,461 B2 * 5/2019 Jin ..... A44B 19/24
10,709,212 B1 7/2020 Bharadwaj
(Continued)

FOREIGN PATENT DOCUMENTS

CN 216907067 U 7/2022
EP 3766371 A1 1/2021
(Continued)

OTHER PUBLICATIONS

International Search Report (with translation) and Written Opinion received in corresponding International Application No. PCT/JP2020/048593, mailed Mar. 9, 2021, in 9 pages.
(Continued)

*Primary Examiner* — Robert Sandy
*Assistant Examiner* — Louis A Mercado
(74) *Attorney, Agent, or Firm* — Procopio, Cory, Hargreaves & Savitch LLP

(57) ABSTRACT

Stop part includes a magnetic body and a base portion in which an entirety of the magnetic body is embedded. The base portion first and second resin portions which are distinguishable based on an interface formed between the portions. The first and second resin portions are arranged to cover separate first and second regions, respectively, in at least one surface of the magnetic body.

19 Claims, 12 Drawing Sheets

(56) References Cited

U.S. PATENT DOCUMENTS

| | | | | |
|---|---|---|---|---|
| 11,425,972 | B2 * | 8/2022 | Ekko | A44B 19/384 |
| 11,432,622 | B2 * | 9/2022 | Owings | A44B 19/06 |
| 11,627,784 | B2 * | 4/2023 | Tung | A44B 19/38<br>24/433 |
| 11,825,919 | B2 * | 11/2023 | Naka | A44B 19/262 |
| 2005/0050699 | A1 | 3/2005 | Yoeoka | |
| 2007/0277353 | A1 * | 12/2007 | Kondo | A45C 13/1069<br>24/303 |
| 2021/0007446 | A1 | 1/2021 | Ekko et al. | |

FOREIGN PATENT DOCUMENTS

| | | | |
|---|---|---|---|
| JP | 3078682 | U | 7/2001 |
| JP | 2005-246006 | A | 9/2005 |
| JP | 2007-229411 | A | 9/2007 |
| JP | 4152216 | B2 | 9/2008 |
| WO | 2019/175944 | A1 | 9/2019 |
| WO | 2020/095364 | A1 | 5/2020 |

OTHER PUBLICATIONS

International Preliminary Report on Patentability (with translation) in corresponding International Application No. PCT/JP2020/048593, mailed Jul. 6, 2023, in 5 pages.

Office Action dated Oct. 11, 2024, in German Application DE 112020007865.5.

* cited by examiner

[Fig. 1]
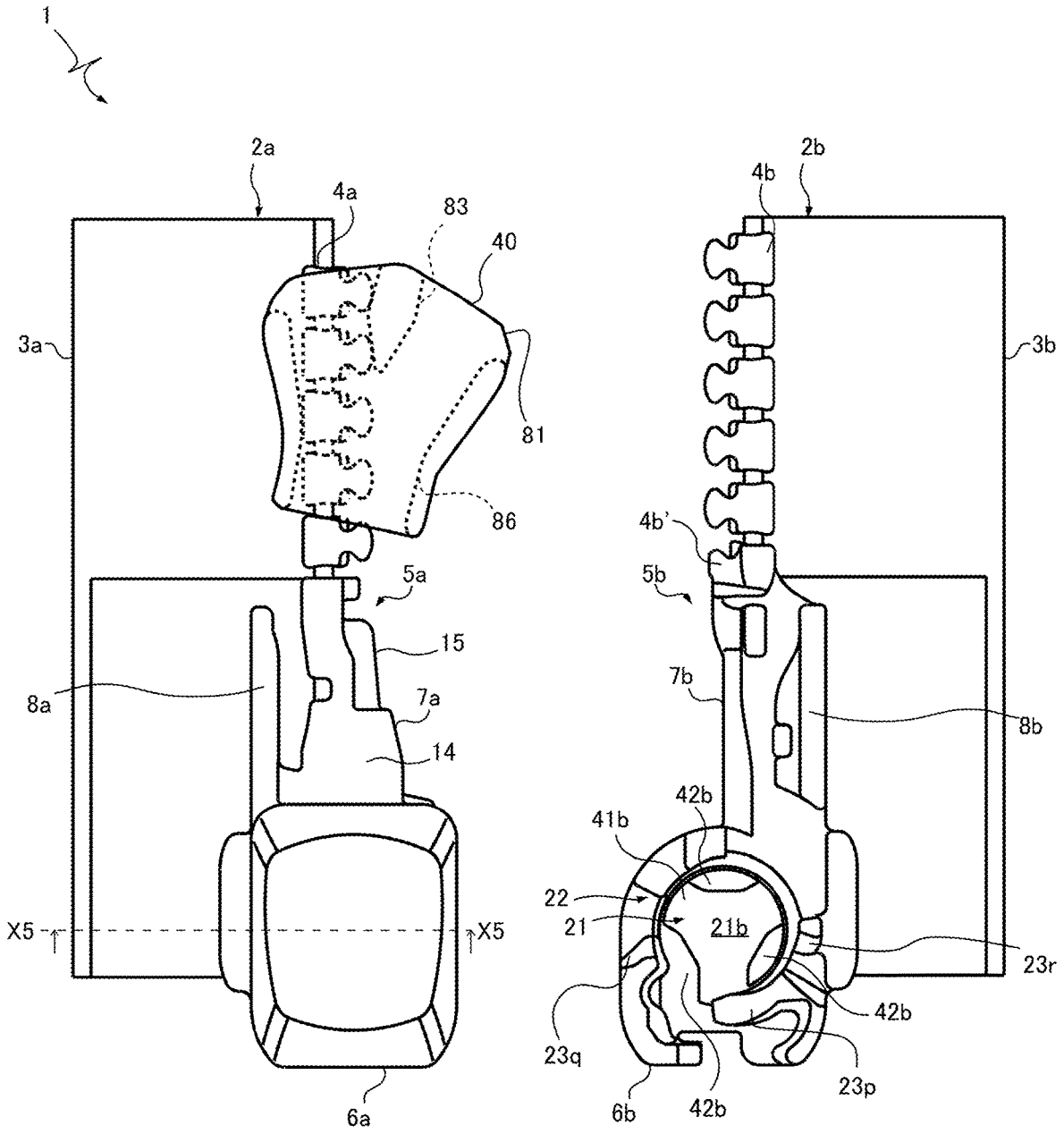

[Fig. 2]
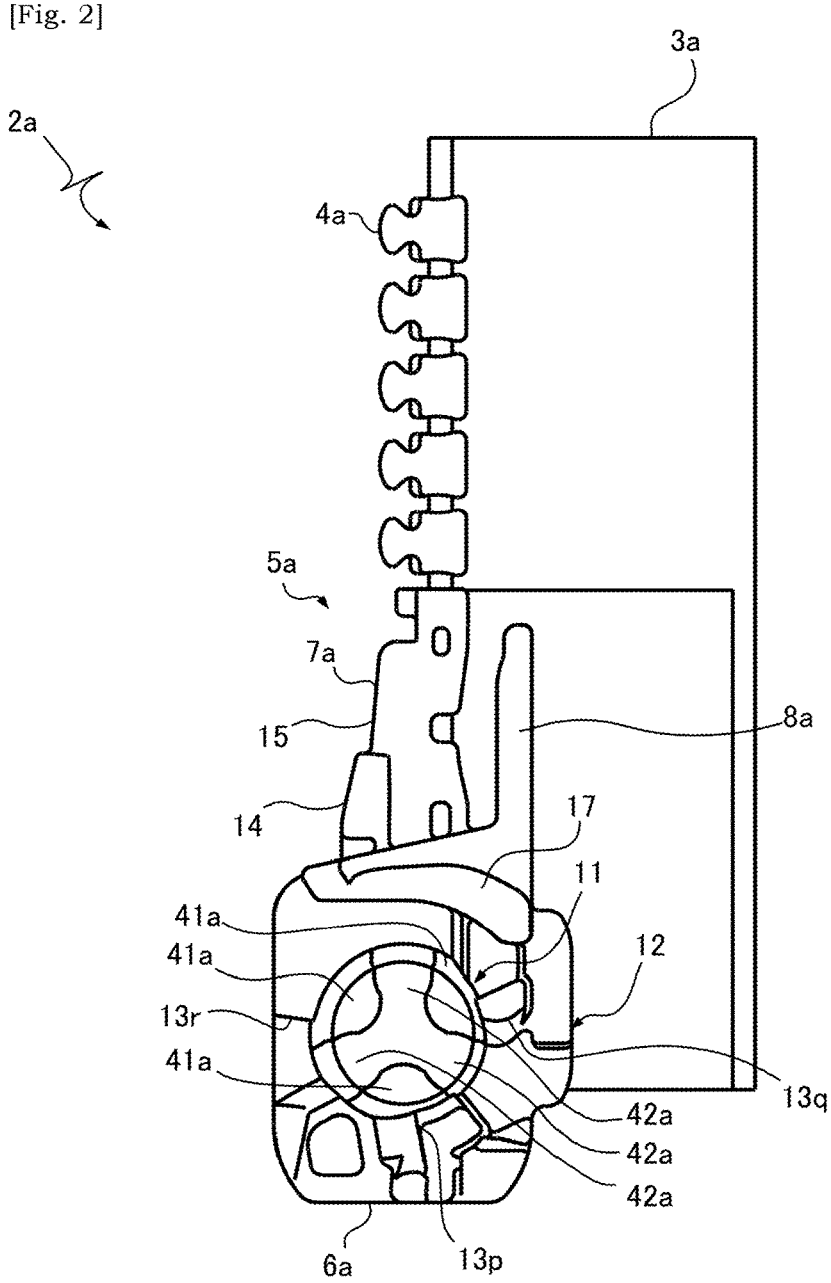
[Fig. 3]
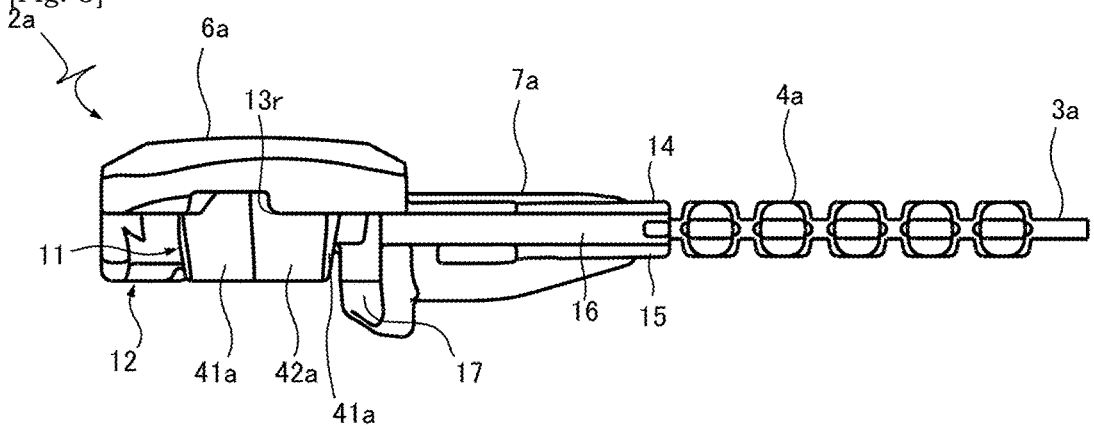

[Fig. 4]
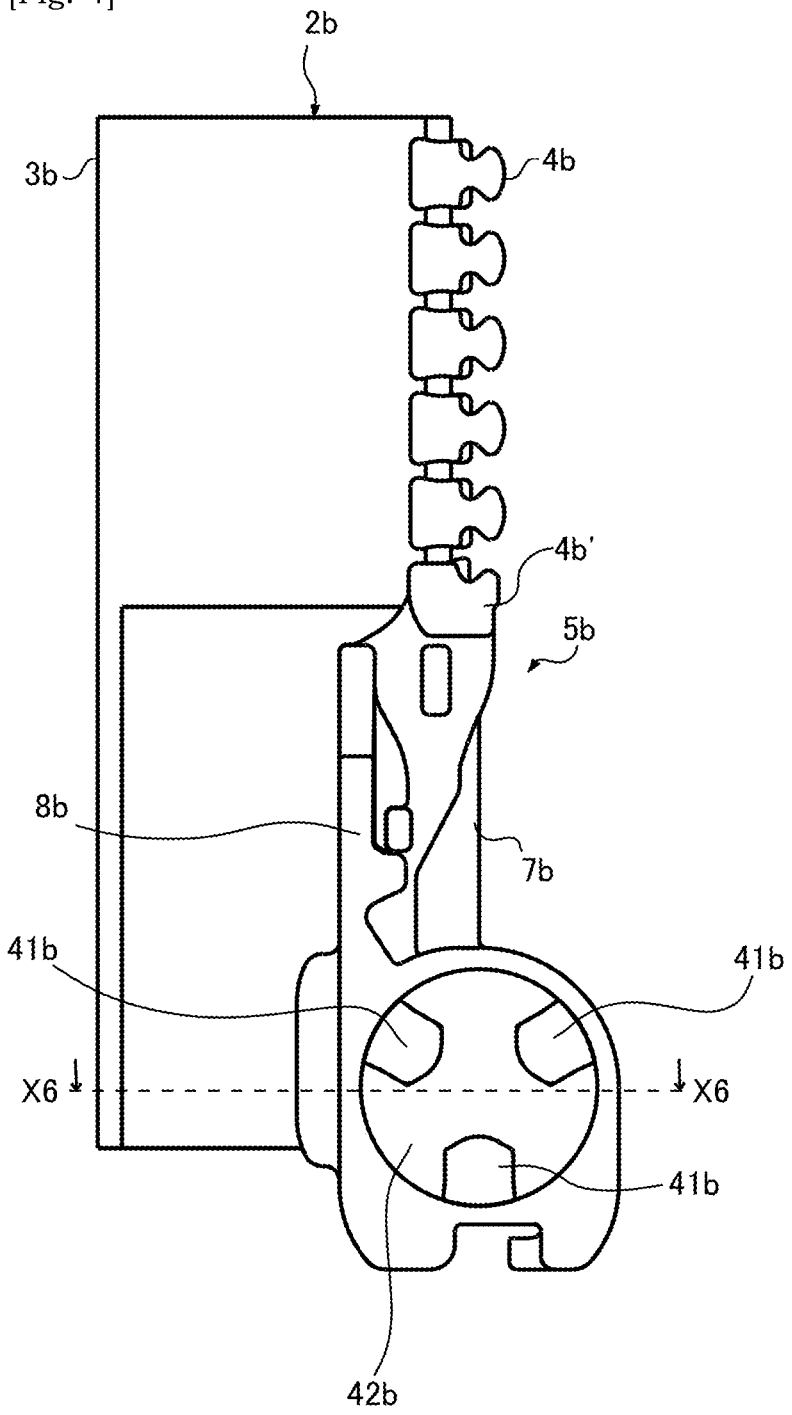

[Fig. 5]
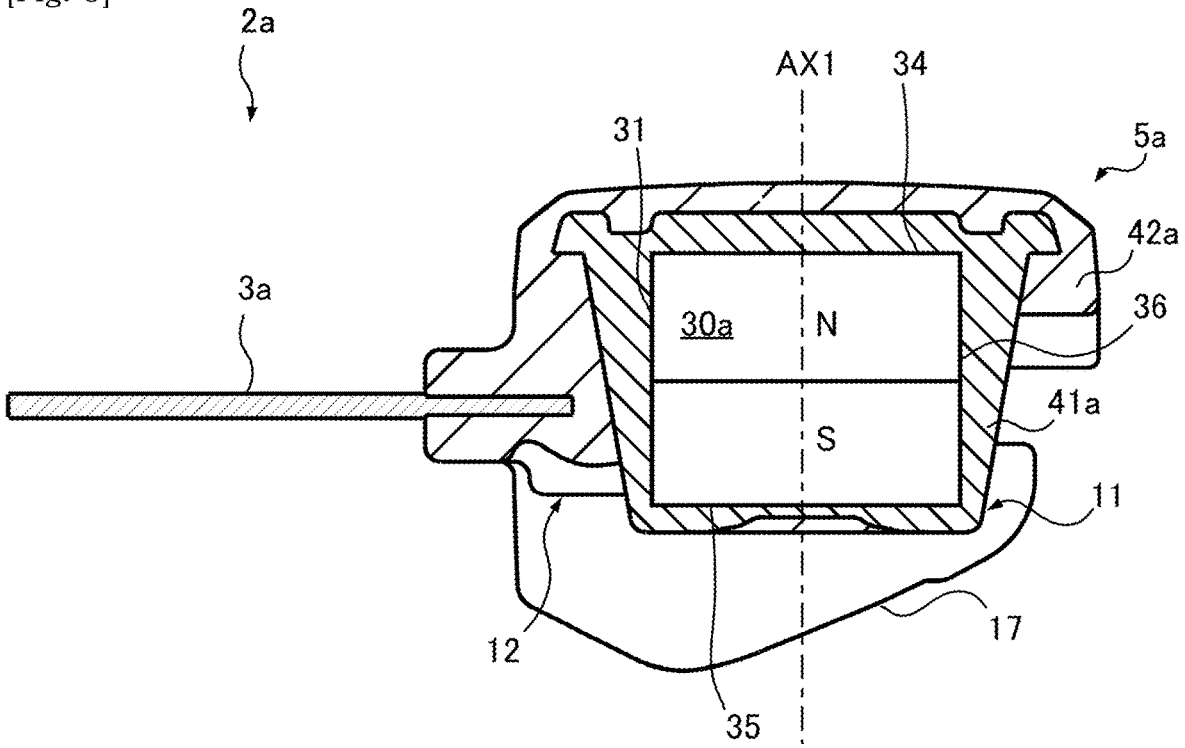
[Fig. 6]
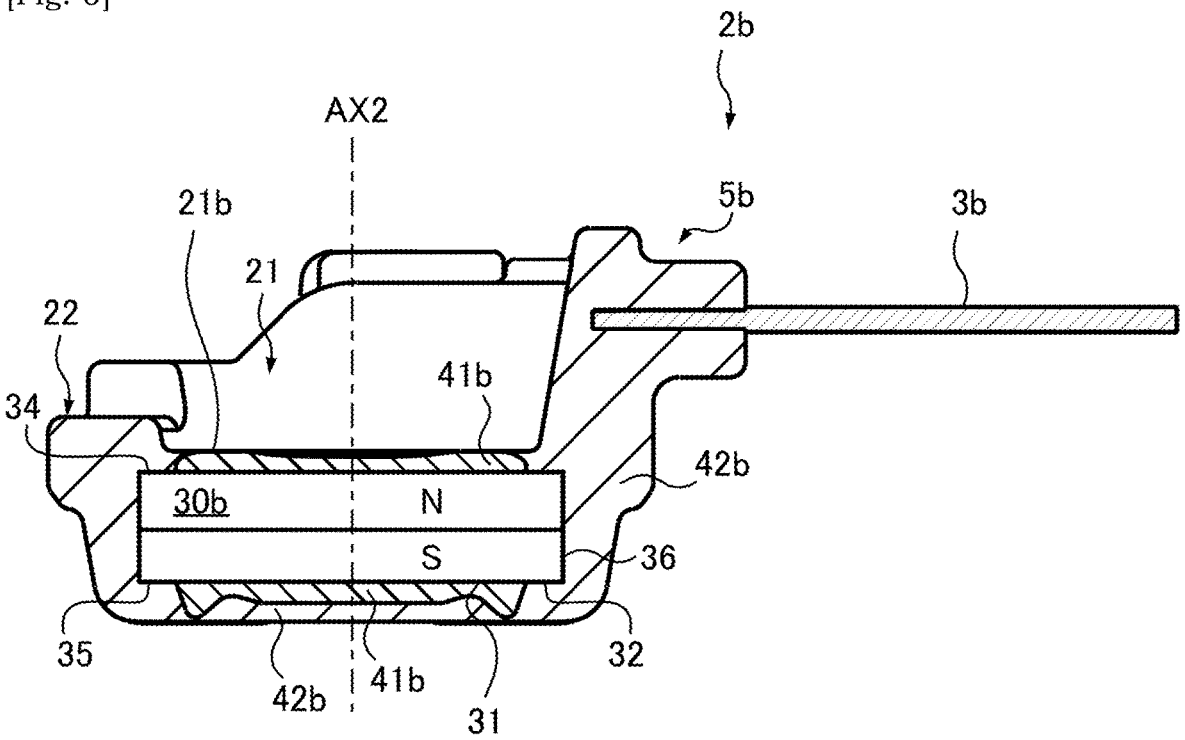

[Fig. 7]
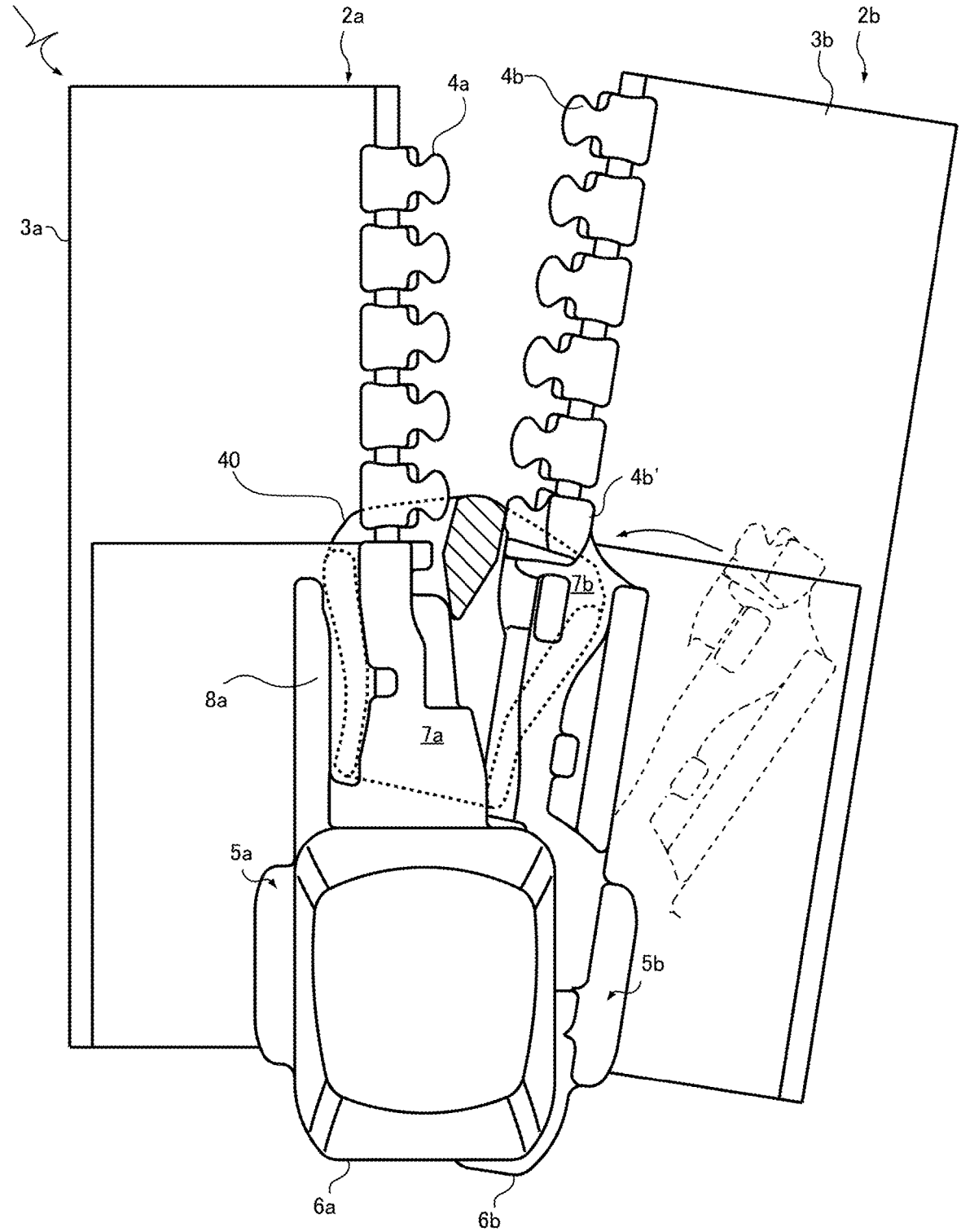

[Fig. 8]
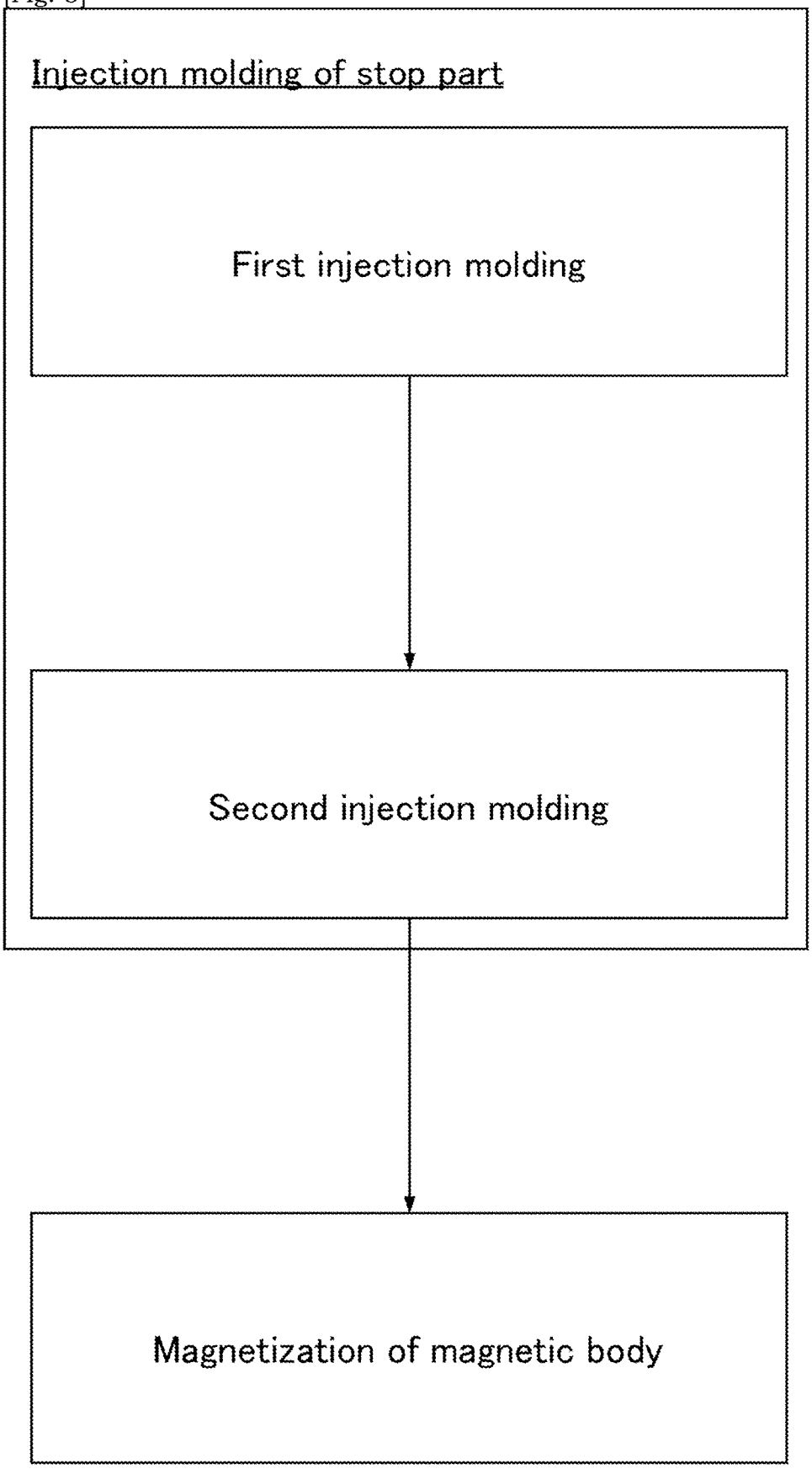

[Fig. 9]
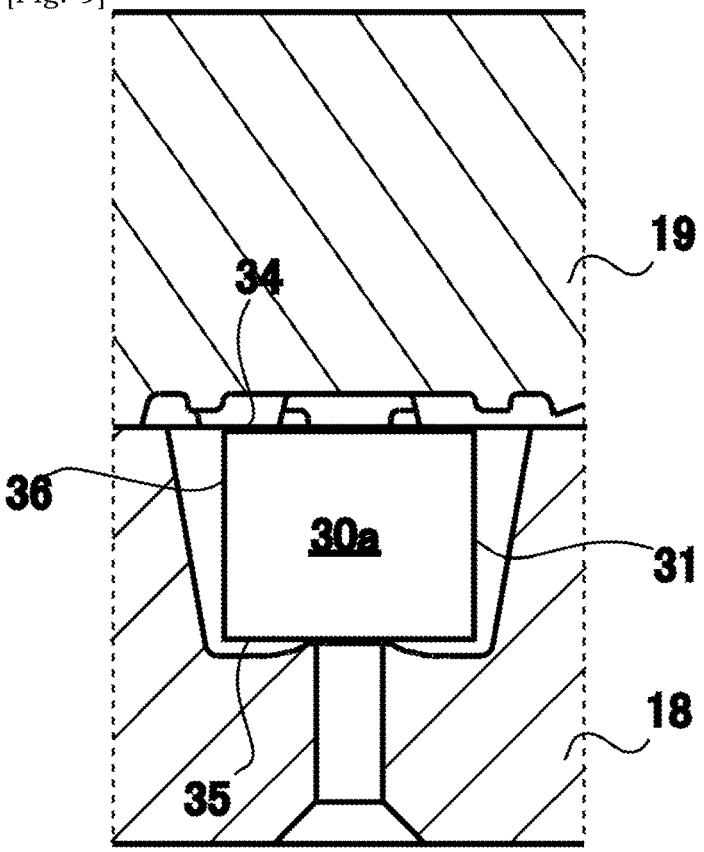
[Fig. 10]
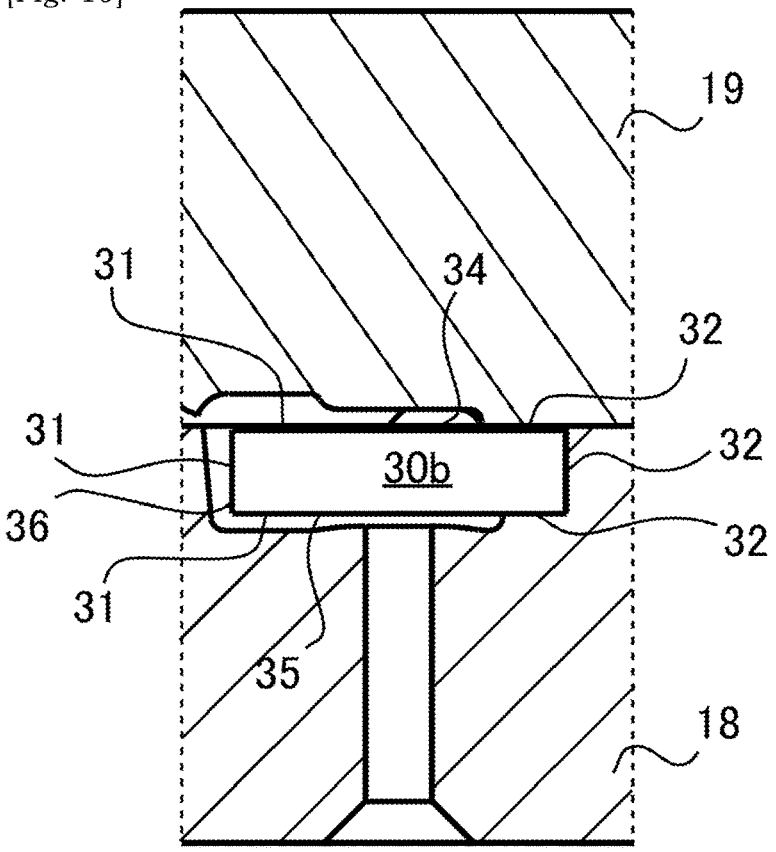

[Fig. 11]
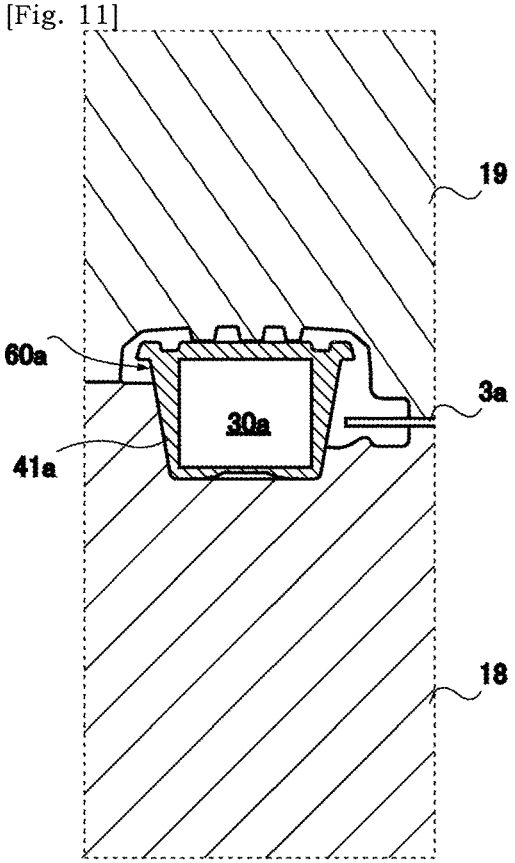
[Fig. 12]
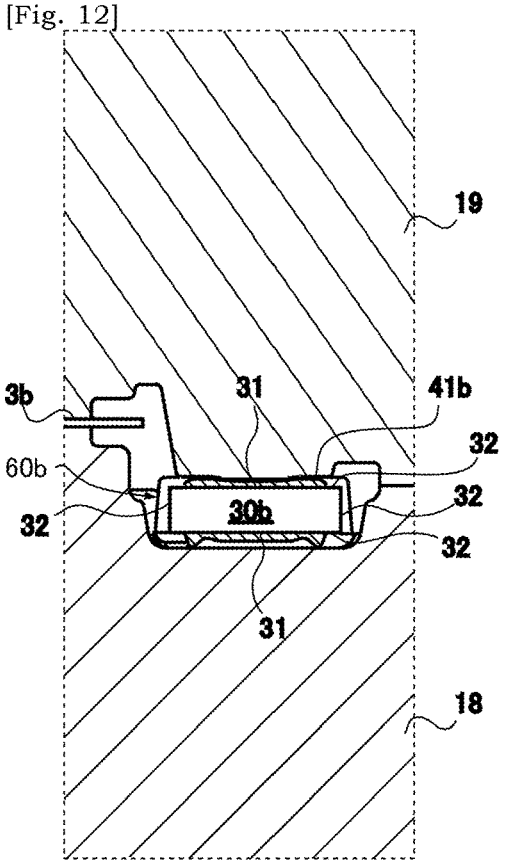

[Fig. 13]
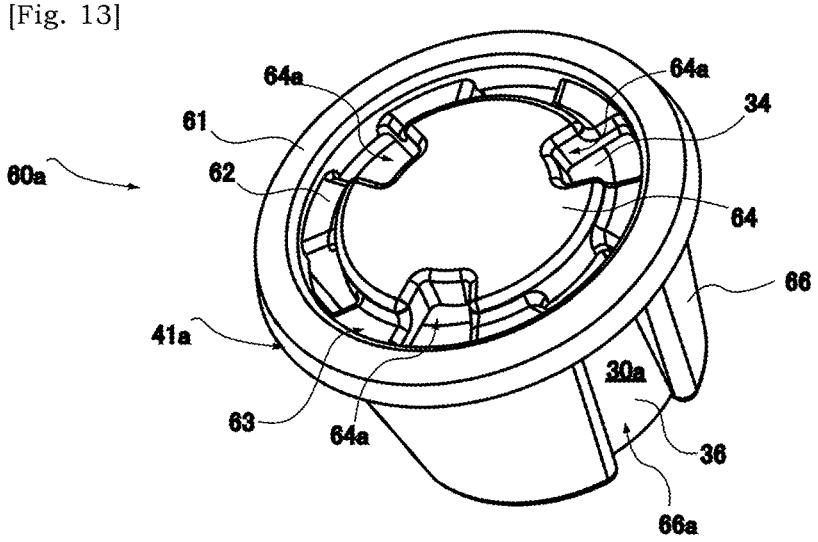
[Fig. 14]
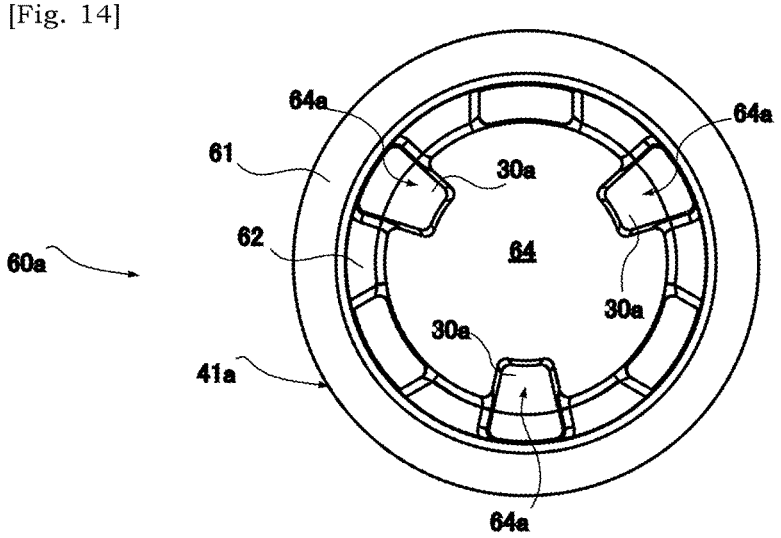
[Fig. 15]
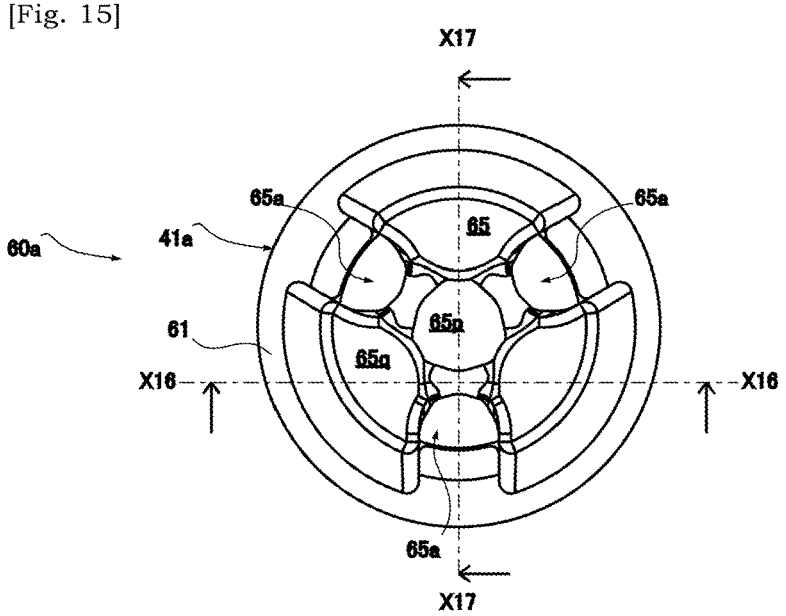

[Fig. 16]
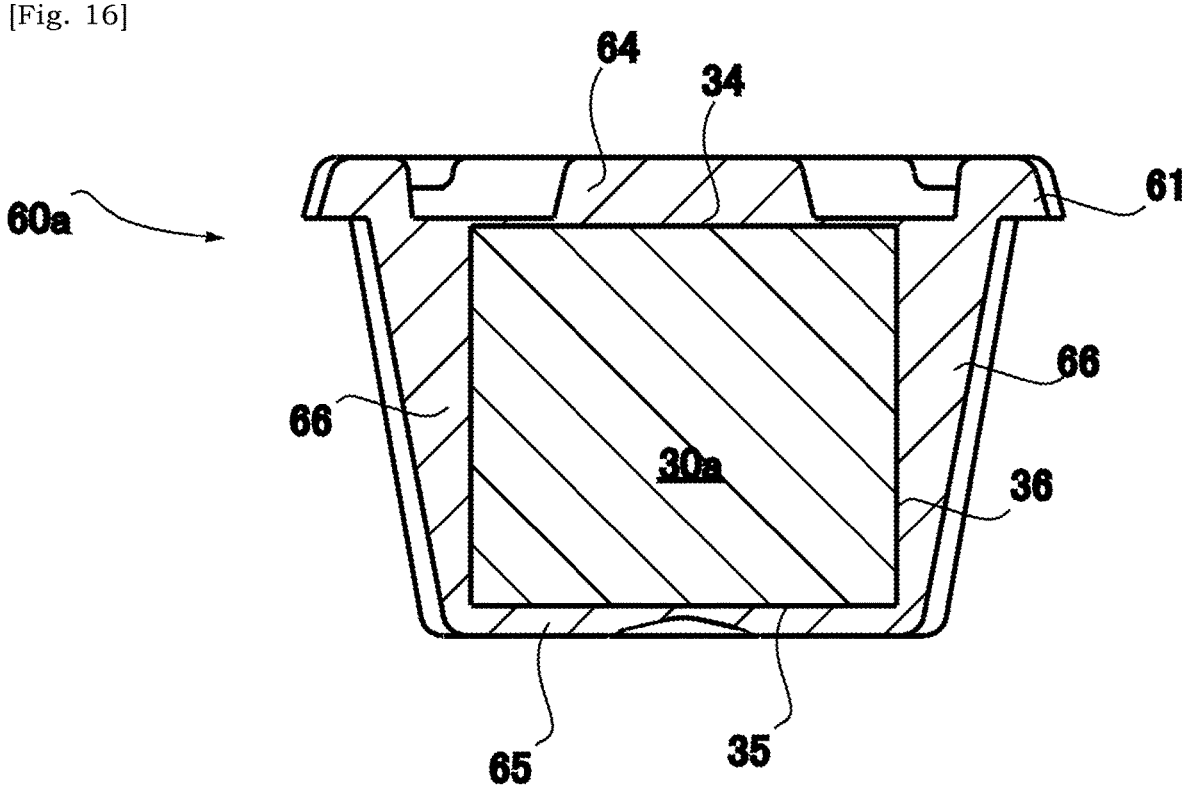
[Fig. 17]
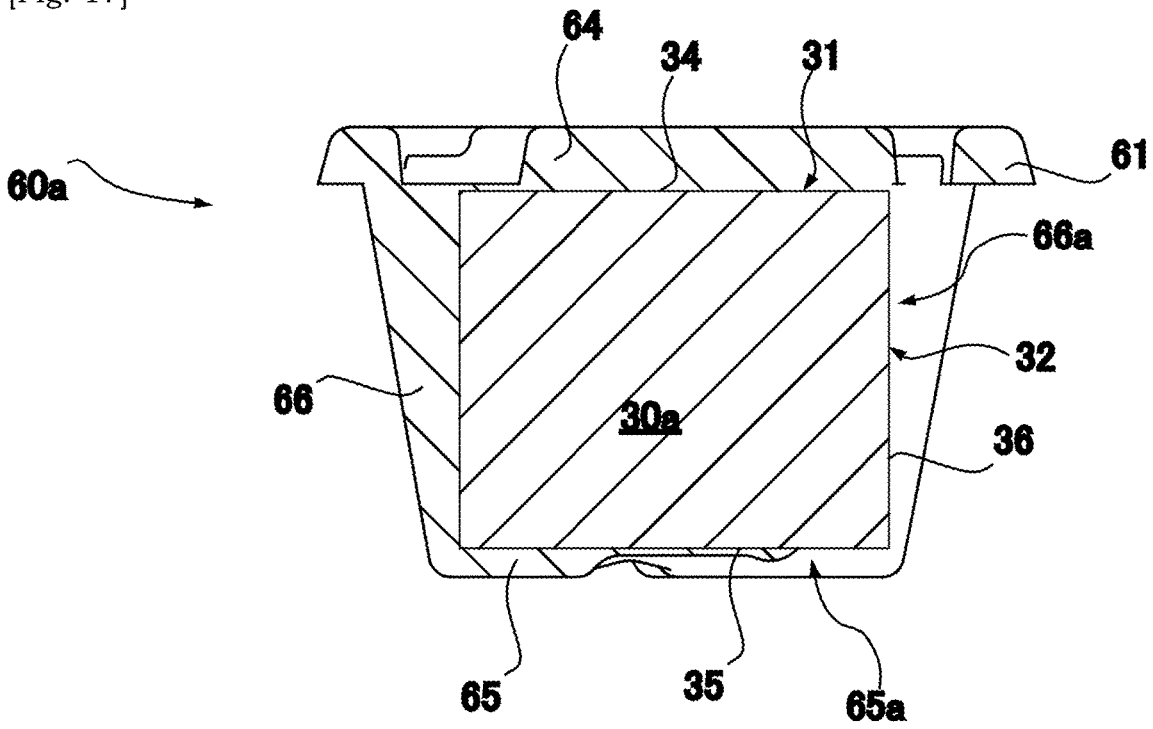

[Fig. 18]
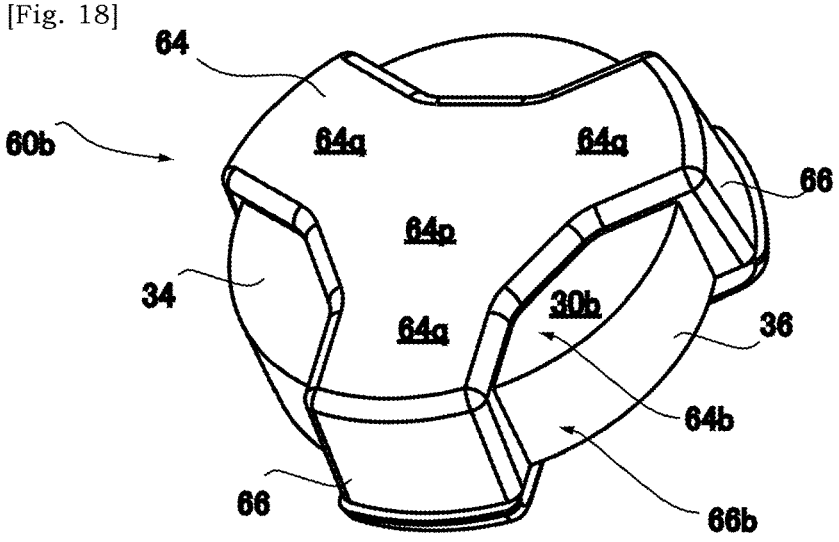
[Fig. 19]
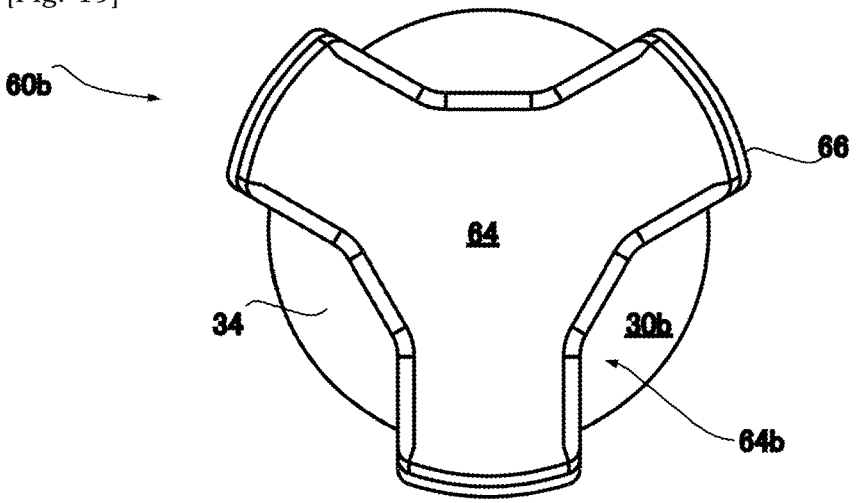
[Fig. 20]
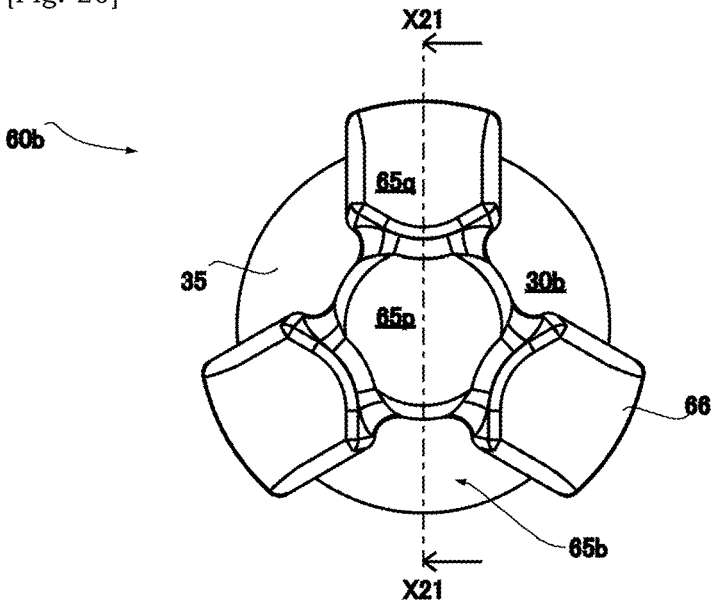

[Fig. 21]
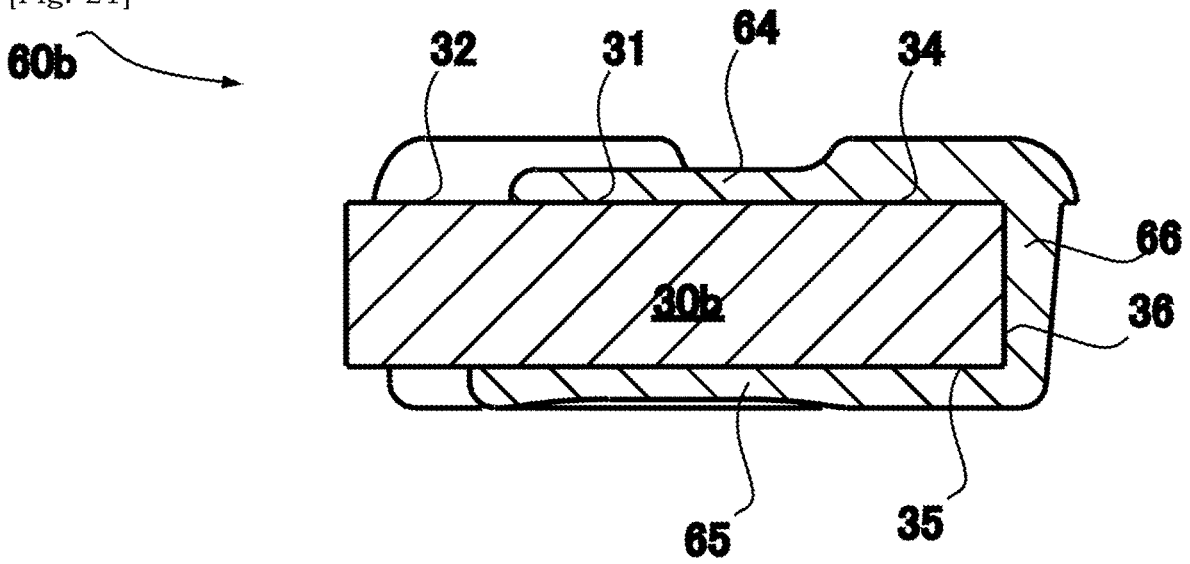

FASTENER STRINGER, SLIDE FASTENER, AND METHOD FOR PRODUCING STOPPER COMPONENT AND SLIDE FASTENER

CROSS-REFERENCE TO RELATED APPLICATIONS

This application is a US national stage application of International Application PCT/JP2020/048593, filed Dec. 24, 2020, the contents of which are incorporated by reference.

TECHNICAL FIELD

The present disclosure relates to fastener stringer, slide fastener and methods for producing stop part and slide fastener.

BACKGROUND ART

There is a need to enhance user-friendliness in connection to opening and closing operation of slide fastener.

Patent literature 1 relates to a stop member of slide fastener and discloses that simplified operation of stop members is facilitated using magnets. In particular, when first and second bases of first and second parts are stacked, magnetic attraction or magnetic repulsion is effected between them and the second base rotates relative to the first base. At this instant, a second insert of the second member pivots toward an interspace between upper and lower flanges of slider. In such a way, the operational burden of stop member required for closing the slide fastener would be reduced. The permanent magnets are housed in housing portions of the bases.

Patent literature 2 discloses that a magnet is attached, by fitting, to a recess of a sliding plate.

Patent literature 3 discloses a slide fastener having magnetically attractable elements. Elastomer including non-magnetized particles is injection-molded, followed by application of magnetic field to magnetize those particles. Strength and position of the magnetic field would be appropriately controlled so that the magnetized particles would form a linear cluster in the elastomer. Then, the elastomer is solidified and a processing is performed for shaping it into fastener elements.

Patent literature 4 discloses that a non-magnetized magnet is attached to a tie and then magnetized.

CITATION LIST

Patent literature

[PTL 1] International Publication No. 2019/175944
[PTL 2] Japanese Patent No. 4 152 216
[PTL 3] U.S. Pat. No. 10 709 212
[PTL 4] Japanese registered utility-model 3 078 682

SUMMARY

Technical Problem

An aspect of the present disclosure aims to strengthen a structure that holds a magnetic body in a stop part.

Solution to Problem

Fastener stringer according to an aspect of the present disclosure includes: a fastener tape provided with a fastener element; and a stop part adhering to the fastener tape at a position adjacent to the fastener element, wherein the stop part includes a magnetic body and a base portion in which an entirety of the magnetic body is embedded, the base portion includes first and second resin portions which are distinguishable based on an interface formed between the first and second resin portions, and the first and second resin portions are arranged to cover separate first and second regions, respectively, in at least one surface of the magnetic body. The first and second resin portions may directly cover the first and second regions respectively. The respective resin portions and the respective regions may be in direct contact, and there may be no interspace between the portion and the region.

In some embodiments, the at least one surface of the magnetic body is covered by the first and second resin portions in a complemental manner; or in each surface of the magnetic body, the first and second regions are covered by the first and second resin portions respectively. In some embodiments, the first resin portion has one or more exposed surfaces exposed as not covered by the second resin portion. The exposed surface may extend radially with respect to a central axis of the magnetic body. In some embodiments, the second resin portion has an exposed surface that extends radially with respect to a central axis of the magnetic body. In some embodiments, a stack portion of the first and second resin portions is provided on a central axis of the magnetic body.

In some embodiments, the base portion has an axial protrusion in which the magnetic body is embedded, and a top surface of the axial protrusion includes exposed surfaces of the first and second resin portions. The base portion may have an axial protrusion in which the magnetic body is embedded, and a side wall of the axial protrusion may be configured by alternate arrangement of a wall of the first resin portion and a wall of the second resin portion in a circumferential direction. The base portion may have a recess having a bottom surface with the magnetic body arranged directly beneath the bottom surface, and the bottom surface of the recess may include exposed surfaces of the first and second resin portions.

In some embodiments, (a) the base portion is provided with an axial protrusion in which the magnetic body is embedded at least partially, and a side wall of the axial protrusion includes a wall of first resin portion and a wall of second resin portion; or (b) the base portion is provided with a recess having a bottom surface with the magnetic body arranged directly beneath the bottom surface, and the bottom surface of the recess includes an exposed surface of the first resin portion and an exposed surface of the second resin portion.

The first resin portion may be configured to receive the magnetic body, and the second resin portion may configure a remainder of the stop part other than the first resin portion. The magnetic body may be a permanent magnet having a pair of main surfaces arranged to cross a magnetic axis and a side surface connecting outer rims of the pair of main surfaces.

Slide fastener according to another aspect of the present disclosure is a slide fastener including a pair of fastener stringers; and a slider movable to open and close the pair of fastener stringers, wherein each of the pair of fastener stringers is any one of fastener stringers described above in which a permanent magnet is provided as the magnetic body, a pair of stop parts in the pair of fastener stringers include the permanent magnets so as to be magnetically attracted each other to cause a stack of the pair of stop parts, one of the pair of stop parts has a sloped surface that is sloped as extending along a circumferential direction with respect to a magnetic axis of the permanent magnet, and the other one of the pair of stop parts has a sliding portion that slides on the sloped surface in accordance with a magnetic attraction between the permanent magnets of the pair of stop parts.

A method of producing a stop part according to yet another aspect of the present disclosure is a method of producing a stop part adhered or to be adhered to a fastener tape of a fastener stringer, the method including: performing an injection molding such that a magnetic body is embedded in the stop part; and applying a magnetic field to the stop part to magnetize the magnetic body after said injection molding.

In some embodiments, said injection molding includes at least two injection moldings, a first region of at least one surface of the magnetic body is covered by a first resin portion during an initial injection molding, and a second region of at least one surface of the magnetic body is covered by a second resin portion during a following injection molding.

A method of producing a slide fastener according to yet further another aspect of the present disclosure is a method of producing a slide fastener having magnetically attractable but separable stop members, the method including: combining, as a pair, fastener stringers of any one of the above-described ones; and applying a magnetic field having a constant direction to stop parts which are included and coupled in the pair to magnetize magnetic bodies respectively embedded in the stop parts.

Advantageous Effects of Invention

According to an aspect of the present disclosure, facilitated is that a structure holding a magnetic body in a stop part is strengthened.

BRIEF DESCRIPTION OF DRAWINGS

FIG. 1 is a schematic top view of a slide fastener in an open state according to an aspect of the present disclosure.

FIG. 2 is a schematic bottom view of the left fastener stringer.

FIG. 3 is a schematic right side view of the left fastener stringer.

FIG. 4 is a schematic bottom view of the right fastener stringer.

FIG. 5 is a schematic cross-sectional schematic view of the left fastener stringer, illustrating a schematic cross-sectional configuration of a left stop part taken along a chain line X5-X5 in FIG. 1.

FIG. 6 is a schematic cross-sectional view of the right fastener stringer, illustrating a schematic cross-sectional configuration of a right stop part taken along a chain line X6-X6 in FIG. 4.

FIG. 7 is a schematic view illustrating that an insert of the right stop part is automatically inserted into the inside of a slider in accordance with magnetic attraction between permanent magnets in the left and right stop parts.

FIG. 8 is a schematic flowchart illustrating a method of producing a stop member.

FIG. 9 is a schematic process diagram illustrating that a first region in each surface of the left magnetic body will be covered by a first resin portion through a process of first injection molding.

FIG. 10 is a schematic process diagram illustrating that a first region in each surface of the right magnetic body will be covered by a first resin portion through a process of first injection molding.

FIG. 11 is a schematic process diagram illustrating that, through a process of second injection molding, a second region (not shown in FIG. 11) in each surface of the left magnetic body will be covered by a second resin portion, and the first resin portion will also be covered by the second resin portion.

FIG. 12 is a schematic process diagram illustrating that, through a process of second injection molding, a second region in each surface of the right magnetic body will be covered by a second resin portion, and the first resin portion will also be covered by the second resin portion.

FIG. 13 is a schematic perspective view of a first molded part in which the left magnetic body is partially covered by the first resin portion.

FIG. 14 is a schematic top view of the first molded part shown in FIG. 13.

FIG. 15 is a schematic bottom view of the first molded part shown in FIG. 13.

FIG. 16 is a schematic cross-sectional view of the first molded part shown in FIG. 15, illustrating a cross-section taken along a chain line X16-X16 in FIG. 15.

FIG. 17 is a schematic cross-sectional view of the first molded part shown in FIG. 15, illustrating a cross-section taken along a chain line X17-X17 in FIG. 15.

FIG. 18 is a schematic perspective view of the first molded part in which the right magnetic body is partially covered by the first resin portion.

FIG. 19 is a schematic top view of the first molded part shown in FIG. 18.

FIG. 20 is a schematic bottom view of the first molded part shown in FIG. 18.

FIG. 21 is a schematic cross-sectional view of the first molded part shown in FIG. 20, illustrating a cross-section taken along a chain line X21-X21 in FIG. 20.

DESCRIPTION OF EMBODIMENTS

Hereinafter, various embodiments and features will be described with reference to drawings. A skilled person would be able to combine respective embodiments and/or respective features without requiring excess description, and would appreciate synergistic effects of such combinations. Overlapping description among the embodiments are basically omitted. Referenced drawings aim mainly for describing inventions and are simplified for the sake of convenience of illustration. The respective features should be appreciated as universal features not only effective to a fastener stringer and stop part presently disclosed but also effective to other various fastener stringers and stop parts not disclosed in the present specification.

In the following descriptions, Front-rear direction matches a direction (up-down direction when FIG. 1 is viewed in front) in which a slider moves so as to open and close a slide fastener. Left-right direction is a direction (left-right direction when FIG. 1 is viewed in front) orthogonal to the front-rear direction and parallel to a tape surface of a fastener tape. Up-down direction is a direction orthogonal to the front-rear direction and perpendicular to a tape surface of the fastener tape. The tape surface of the fastener tape is a surface for defining a thickness of the fastener tape.

The slide fastener 1 has left and right fastener stringers 2*a* and 2*b*, and a slider 40 for opening and closing the slide fastener 1. As the slider 40 moves frontward, the slide fastener 1 is closed and the left and right fastener stringers 2*a* and 2*b* are coupled. As the slider 40 moves rearward, the slide fastener 1 is opened and the left and right fastener stringers 2*a* and 2*b* are decoupled.

The slider 40 has an upper wing 81, a lower wing, and an interconnection pillar 83 that interconnects the upper wing 81 and the lower wing. Front mouths are arranged at the left and right sides of the interconnection pillar 83. A rear mouth is arranged at the opposite side of these front mouths. An insert 7*a* described below is inserted into the inside of the slider 40 via the rear mouth of the slider 40. Flanges 86, downwardly protruded and extending along the front-rear direction, are arranged at the left and right side-edges of the upper wing 81. Flanges, upwardly protruded and extending along the front-rear direction, are arranged at the left and right side-edges of the lower wing. An insert 7*b* described below is inserted into the interspace between these upper and lower flanges. When the slider 40 is situated frontward away from the stop parts 5*a* and 5*b*, the fastener tape 3*b* has been inserted in the interspace between the upper and lower flanges of the slider 40. Each of the fastener stringers 2*a* and 2*b* has a fastener tape 3*a*,3*b* provided with a fastener element 4*a*,4*b*, and a stop part 5*a*,5*b* adhering to the fastener tape 3*a*,3*b* at a position adjacent to the fastener element 4*a*,4*b*. The fastener tape is a belt-like member having softness and elongated in the front-rear direction, and is a woven fabric, knitted fabric or mixture of these fabrics. The fastener element is configured to be engageable with a partner element and for example, is a resin-made or metal-made element or a coil-like element of helically wound monofilament. The fastener element is adhered to the fastener tape through injection molding, swaging, sewing or adhesion. The illustrated fastener element is a resin-made element having a base portion, a neck and a head. The base portion adheres to the side-edge portion of the fastener tape.

The stop parts 5*a* and 5*b* are capable of being coupled in a separable manner. Each of the stop parts 5*a* and 5*b* has a base portion 6*a*,6*b* and an insert 7*a*,7*b* that extends toward the fastener element 4*a*,4*b* away from the base portion 6*a*,6*b* (i.e. frontward). The entireties of magnetic bodies 30*a* and 30*b* are embedded in the base portions 6*a* and 6*b* (See FIGS. 5 and 6) respectively. The magnetic bodies 30*a* and 30*b* have different shapes and here, the magnetic body 30*a* has a cylindrical shape and the magnetic body 30*b* has a discoid shape. As described above, the insert 7*a* is inserted into the inside of the slider 40 via its rear mouth. The insert 7*b* is inserted into the inside of the slider 40 via the interspace between the flange of the upper wing 81 and the flange of the lower wing. Note that, the configurations of the stop parts 5*a* and 5*b* can be inverted in the left-right direction.

The base portion 6*a* of the left stop part 5*a* has an axial protrusion 11 in which the magnetic body 30*a* is embedded. The axial protrusion 11 is arranged to protrude downward. The base portion 6*b* of the right stop part 5*b* has a recess 21 having a bottom surface 21*b* with the magnetic body 30*b* arranged directly beneath the bottom surface 21*b*. The magnetic bodies embedded in the base portions of the stop parts illustrated in FIGS. 1 to 5 and 6 are permanent magnets produced through magnetization of non-magnetized magnetic bodies (the magnetic bodies 30*a* and 30*b* may be referred to as permanent magnets 30*a* and 30*b* hereinbelow). Accordingly, when the base portion 6*a* of the left stop part 5*a* and the base portion 6*b* of the right stop part are positioned to be spatially close to each another (e.g. when the base portion 6*b* is arranged beneath the base portion 6*a*), a magnetic attraction is effected between the permanent magnet 30*b* of the base portion 6*b* and the permanent magnet 30*a* of the base portion 6*a*, allowing the base portion 6*a* and the base portion 6*b* to be stacked one another and allowing the axial protrusion 11 of the base portion 6*a* to fit to the recess 21 of the base portion 6*b*.

The permanent magnet 30*a*,30*b* may be a rare-earth magnet such as a neodymium magnet. The permanent magnet 30*a*,30*b* has, as total 3 surfaces, a pair of main surfaces 34 and 35 arranged to cross a magnetic axis AX1,AX2 (or that define a thickness of the permanent magnet), and a side surface 36 connecting the outer rims of the main surfaces 34 and 35 of the pair (See FIGS. 5 and 6). The side surface 36 extends along the magnetic axis AX1,AX2 at a position radially outward from the magnetic axis AX1,AX2 to couple the outer rim of the main surface 34 and the outer rim of the main surface 35.

The magnetic axis AX1,AX2 of the permanent magnet 30*a*,30*b* matches a central axis of the magnetic body 30*a*, 30*b*. The magnetic axis is an axis extending along an arrangement direction of N-pole and S-pole of the permanent magnet, and is defined based on the lines of magnetic force formed about the permanent magnet. The central axis AX1 of the magnetic body 30*a* matches a central axis of the axial protrusion 11. The central axis AX2 of the magnetic body 30*b* matches a depth direction of the recess 21. Note that the permanent magnets 30*a* and 30*b* can be shaped like a prism or a polygonal plate. Other shapes such as a cone, a pyramid, or a sphere can also be employed.

The base portion 6*a* has an outer peripheral portion 12 arranged around the axial protrusion 11. Sliding portions 13*p*,13*q*,13*r* are arranged in the outer peripheral portion 12. The base portion 6*b* has an outer peripheral portion 22 arranged around the recess 21. Sloped surfaces 23*p*,23*q*,23*r* are arranged in the outer peripheral portion 22. While the axial protrusion 11 fits to the recess 21 in accordance with the magnetic attraction between the permanent magnets as described above, the sliding portion 13*p*,13*q*,13*r* and the sloped surface 23*p*,23*q*,23*r* are brought into contact and the sliding portion 13*p*,13*q*,13*r* slides down the sloped surface 23*p*,23*q*,23*r*, resulting in a rotation of the base portion 6*b* relative to the base portion 6*a*. It can be said that the magnetic attraction effected in the axial direction is converted into a rotational force around the axial direction.

The insert 7*a* is configured to be open at the right side to receive the insert 7*b*. As shown in FIG. 3, the insert 7*a* has an upper plate 14 and a lower plate 15, and an insertion space 16 is defined between the plates 14 and 15. Also, as shown in FIG. 2, a bar 8*a* is arranged adjacent to the insert 7*a* on the both upper and lower sides of the fastener tape 3*a*, and a flange passage is defined on the both upper and lower sides of the fastener tape 3*a*. Similar to the insert 7*a*, the bar 8*a* extends frontward from the base portion 6*a*. The flange of the slider 40 is inserted into the flange passage between the insert 7*a* and the bar 8*a*, facilitating that the slider 40 is kept on the insert 7*a*.

The insert 7*b* has an insertion end shaped to taper as extending leftward away from the fastener tape 3*b*, and the insertion end will be smoothly inserted into the interspace between the right-side upper and lower flanges of the slider 40. Modified fastener element 4*b*′ is coupled to a front end of the insert 7*b*, allowing the slider 40 to smoothly move onto the fastener elements 4*a* and 4*b* from a position over the stop member. The bar 8*b* is connected to the insert 7*b* at the opposite side of the insertion end. The bar 8*b* is arranged to protrude on the both upper and lower surfaces of the fastener tape 3*b* and collides with the right-side upper and lower flanges of the slider 40. The bar 8*b* defines a stop position for the insert 7*b* that is to be inserted into the inside of the slider 40.

As shown in FIG. 7, when the slider 40 is positioned at a rearmost position (i.e. when the insert 7*a* is inserted into the inside of the slider 40) and when the base portion 6*b* is positioned beneath the base portion 6*a*, the magnetic attraction would be effected between the permanent magnet 30*a* of the base portion 6*b* and the permanent magnet 30*b* of the base portion 6*a*. This magnetic attraction allows the base portion 6*a* and the base portion 6*b* to be stacked one another and allows the axial protrusion 11 of the base portion 6*a* to fit to the recess 21 of the base portion 6*b*. While the axial protrusion 11 fits to the recess 21 (i.e. while the base portions 6*a* and 6*b* approach one another along the axial direction), the sliding portion 13*p*,13*q*,13*r* and the sloped surface 23*p*,23*q*,23*r* are brought into contact and the sliding portion 13*p*,13*q*,13*r* slides down the sloped surface 23*p*,23*q*,23*r*. In accordance with this, the base portion 6*b* rotates counter-clockwise relative to the base portion 6*a*, and the insert 7*b* is inserted into the inside of the slider 40 via the interspace between the right-side upper and lower flanges of the slider 40. As the slider 40 moves frontward, the insert 7*b* is inserted into an insertion space 16 of the insert 7*a* and the left and right stop parts 5*a* and 5*b* are coupled. As the slider 40 moves frontward further, the left and right fastener elements 4*a* and 4*b* are engaged.

The sliding portions 13*p*,13*q*,13*r* are arranged in a circumferential direction about the magnetic axis AX1 of the permanent magnet 30*a*. Likewise, the sloped surfaces 23*p*, 23*q*,23*r* are arranged in a circumferential direction about the magnetic axis AX2 of the permanent magnet 30*b*. Each sloped surface is sloped as extending in a circumferential direction about the magnetic axis AX2 of the permanent magnet 30*b*. The sliding portion 13*p*,13*q*,13*r* slides on (descends) the sloped surface 23*p*,23*q*,23*r* in accordance with the magnetic attraction between the permanent magnets 30*a* and 30*b*. The arrangement of 3 sliding portions allows increased rotational stability, but the arrangement of just one sliding portion might be sufficient. The same applies to the sloped surface. Of course, it is also possible to omit the sliding portions and the sloped surfaces and to rotate the base portion 6*b* relative to the base portion 6*a* by hand. The permanent magnets 30*a* and 30*b* would be aligned such that the respective magnetic axes AX1 and AX2 match, and thus it would be possible to omit the axial protrusion 11 and the recess 21.

The base portion 6*a* has a guide 17 arranged adjacent to and rearward of the insert 7*a* and protruded downward likewise the axial protrusion 11. The guide 17 is arranged to define a groove that is in spatial communication to the orifice of the insert 7*a*, and has a guide surface that is inclined downward rightwardly. When the base portions 6*a* and 6*b* are attracted magnetically each other, the insert 7*b* may possibly be placed onto the guide surface of the guide 17. Even in this case, the insert 7*b* can descend on the guide surface of the guide 17 and pivot clockwise to the right. The insert 7*b* can enter into the inside of the slider 40 via the interspace between the right-side upper and lower flanges of the slider 40 similar to the above, after descending across the guide surface of the guide 17.

In the present embodiment, the base portion 6*a* includes first and second resin portions 41*a* and 42*a* which are distinguishable based on an interface formed between the portions (see FIGS. 2, 3 and 5). The first and second resin portions 41*a* and 42*a* are arranged to cover separate first and second regions 31 and 32 respectively in at least one surface of the magnetic body 30*a* (See FIG. 17). This enables that the increased thickness of resin portion around the magnetic body 30*a* is suppressed and a structure of the stop part 5*a* for holding the magnetic body 30*a* is strengthened. In particular, the thicknesses of the first and second resin portions 41*a*, 41*b*,42*a*,42*b* on at least one surface of the magnetic body 30*a* can be increased, and the second resin portion 42*a*,42*b* can be interposed between the first resin portions 41*a* and 41*b*, facilitating strengthened interconnection therebetween. Compared with a case where a magnetic body is housed in a recess and this recess is closed by a lid, a structure required for securement of the lid (e.g. nail and slot with which the nail is fitted) can be omitted.

Just as a cation, when the first region 31 is covered by the first resin portion 41*a*, the first resin portion 41*a* is in direct contact with the first region 31 (there is no interspace between them). Similarly, when the second region 32 is covered by the second resin portion 42*a*, the second resin portion 42*a* is in direct contact with the second region 32 (there is no interspace between them). The first and second resin portions 41*a* and 42*a* may be formed from a same resin material but can be distinguishable based on an interface formed between the portions. The second region 32 can be formed based on contact between the magnetic body and a mold surface during a first injection molding, for example.

The same descriptions as described above would apply to the base portion 6*b*. The above descriptions would be read with respective replacements of the base portion 6*a*, the magnetic body 30*a* and the first and second resin portions 41*a*,42*a* with the base portion 6*b*, the magnetic body 30*b* and the first and second resin portions 41*b*,42*b*, thus overlapped descriptions would be omitted. FIGS. 1, 4 and 6 would be referred for the base portion 6*b*. FIG. 6 illustrates that, in each of the main surfaces 34 and 35 of the magnetic body 30*b*, the first region 31 is covered by a first resin portion 41*b* and a second region 32 is covered by a second resin portion 42*b*.

At least one surface of the permanent magnet 30*a*,30*b* (e.g. a main surface and/or a side surface) may be covered by the first resin portion 41*a*,41*b* and the second resin portion 42*a*,42*b* in a complemental manner. This avoids that the surface of the permanent magnet 30*a*,30*b* is not covered by the first and second resin portions and partially exposed in the stop part 5*a*, 5*b*. Alternatively, this would cancel a need to provide an additional resin portion to suppress that exposure. Preferably, in each surface (i.e. all surfaces) of the main surface 34,35 and the side surface 36 of the permanent magnet 30*a*,30*b*, the first and second regions 31,32 are covered by the first and second resin portions 41*a*,41*b*,42*a*, 42*b* respectively.

The first resin portion 41*a*,41*b* may have one or more exposed surfaces that is not covered by the second resin portion 42*a*,42*b* and is exposed in the stop part 5*a*,5*b*. There is a restriction on the thickness of the resin portion around the magnetic body 30*a*,30*b*, but the first resin portion 41*a*,41*b* can be formed to be thicker and a strength of the first resin portion 41*a*,41*b* can be ensured. Note that the exposed surface of the first resin portion 41*a*,41*b* can be formed by contact between the first molded part and a mold surface during a second injection molding. From a viewpoint of suppression of defective moldings, the exposed surface of the first resin portion 41*a*,41*b* or the exposed surface of the second resin portion 42*a*,42*b* preferably extends radially with respect to the central axis of the magnetic body 30*a*,30*b*.

More detail descriptions will be presented below. As shown in FIG. 1, the bottom surface 21*b* of the recess 21 in the base portion 6*b* is configured by a combination of the exposed surface of the first resin portion 41*b* and the exposed surface of the second resin portion 42*b*. In the bottom surface 21*b* of the recess 21, the first resin portion 41*b* has an exposed surface formed in a radial (Y-shaped) pattern. This radial exposed surface has a central surface and a plurality of extending surfaces extending radially outward from the central surface. The exposed surface of the second resin portion 42*b* is interposed between the extending surfaces. The exposed surfaces of the second resin portion 42*b* are arranged at constant angular intervals in the circumferential direction about the central axis AX2 of the magnetic body 30*b*. As such, the bottom surface 21*b* of the recess 21 is formed by the radial exposed surface of the first resin portion 41*b* and the total 3 exposed surfaces of the second resin portion 42*b*.

As shown in FIG. 4, the lower surface of the base portion 6*b* at the opposite side of the recess 21 is configured by a combination of the exposed surface of the first resin portion 41*b* and the exposed surface of the second resin portion 42*b*. In the lower surface of the base portion 6*b* at the opposite side of the recess 21, the second resin portion 42*b* has an exposed surface that is formed in a radial (Y-shaped) pattern. The radial exposed surface has a central surface and a plurality of extending surfaces extending radially outward from the central surface. The width of the extending surface differs between radially inward position and radially outward position. As the extending surface extends away from the central surface, the width of the extending surface gradually decreases, and the width of the extending surface suddenly increases after passing a border between the radially inward position and the radially outward position. The radially outward region of the extending surface is shaped like a fan. The exposed surfaces of the first resin portion 41*b* is interposed between the extending surfaces. The respective exposed surfaces of the first resin portion 41*b* extend radially outward about the central axis AX2 of the magnetic body 30*b*. Therefore, it could be said that the total 3 exposed surfaces of the first resin portion 41*b* are formed in a radial pattern. The total 3 exposed surfaces of the first resin portion 41*b* are arranged at constant angular intervals in the circumferential direction about the central axis AX2 of the magnetic body 30*b*. As such, the lower surface of the base portion 6*b* is formed by the radial exposed surface of the second resin portion 42*b* and the total 3 exposed surfaces of the first resin portion 41*b*.

Note that, at the side of the lower surface of the base portion 6*b*, the first resin portion 41*b* and the second resin portion 42*b* are stacked on the central axis AX2 of the magnetic body 30*b*, that is the first resin portion 41*b* is covered by the second resin portion 42*b* on the central axis AX2 of the magnetic body 30*b*. This facilitates that molten resin, which will be the second resin portion 42*b*, smoothly flows into grooves interposed in the first resin portion 41*b*. As a result, a strengthened interconnection between the first and second resin portions would be achieved, and the structure for holding the magnetic body would also be strengthened. Also at the side of the upper surface of the base portion 6*b*, the first resin portion 41*b* may be covered by the second resin portion 42*b* similarly to the above.

As shown in FIG. 2, the top surface and/or the side surface of the axial protrusion 11 is configured by a combination of the exposed surface of the first resin portion 41*a* and the exposed surface of the second resin portion 42*a*. In the top surface of the axial protrusion 11, the second resin portion 42*a* has the exposed surface formed in a radial (Y-shaped) pattern. This radial exposed surface has a central surface and a plurality of extending surfaces radially outwardly extending from the central surface. The exposed surface of the first resin portion 41*a* is interposed between the extending surfaces. These exposed surfaces of the first resin portion 41*a* are arranged at constant angular intervals in the circumferential direction about the central axis AX1 of the magnetic body 30*a*.

In the side surface of the axial protrusion 11, the exposed surface of the first resin portion 41*a* and the exposed surface of the second resin portion 42*a* are arranged alternately in the circumferential direction with respect to the central axis AX1 of the magnetic body 30*a*. Each of the exposed surfaces of the first and second resin portions 41*a*,42*a* is formed in the extent to be in both of the top surface and the side surface of the axial protrusion 11. Therefore, the side wall of the axial protrusion 11 would be configured by alternate arrangement of the walls of the first resin portion 41*a* and the walls of the second resin portion 42*a* in the circumferential direction with respect to the central axis AX1 of the magnetic body 30*a*. There is a restriction on the thickness of the resin portion around the magnetic body 30*a*, but the respective resin portions can be formed to be thicker and a strength of the resin portions about the magnetic body 30*a* can be ensured.

Note that the first resin portion 41*a* and the second resin portion 42*a* are stacked in the central axis AX1 of the magnetic body 30*a* at the side of the top surface of the axial protrusion 11, that is the first resin portion 41*b* is covered by the second resin portion 42*b*. This facilitates that molten resin, which will be the second resin portion 42*a*, smoothly flows into grooves interposed in the first resin portion 41*a*. As a result, a strengthened interconnection between the first and second resin portions would be achieved, and the structure for holding the magnetic body would also be strengthened. Also, the first and second resin portions 41*a*, 42*a* are stacked on the main surface of the magnetic body 30*a* at the opposite side of the top surface of the axial protrusion 11.

For a purpose of enhancing the magnetic attraction between the permanent magnets 30*a* and 30*b*, the resin portion may preferably be formed to be thinner on the main surface of the permanent magnet 30*a* at the side of the top surface of the axial protrusion 11 and similarly, the resin portion may preferably be formed to be thinner on the main surface of the permanent magnet 30*b* at the side of the bottom surface 21*b* of the recess 21. However, there is a restriction with respect to the thickness of the resin portion from a viewpoint of securement of strength. The first and second resin portions cover the first and second regions of a surface of the magnetic body respectively, as described above, facilitating that a desired thickness is ensured for the first and second resin portions regardless of the imposed restriction of the resin thickness. The first and second resin portions are not stacked redundantly, thus the increased size of the stop part is suppressed. In this instance, the first resin portion is covered by the second resin portion on the central axis of the magnetic body (the magnetic axis of the permanent magnet). This facilitates the smooth flow of the second resin portion into the grooves interposed in the first resin portion. Furthermore, upsizing of the stop part would be suppressed as the first resin portion is not covered by the second resin portion to an extent that the first resin portion does not have the exposed surface.

The shape, location, area and number of the exposed surface of the first resin portion 41*a*,41*b* may be modified variously. The same applies to the exposed surface of the second resin portion 42*a*,42*b*. The first resin portion 41*a* does not have an exposed surface in the upper surface of the base portion 6*a* but it may have an exposed surface there.

Each fastener stringer 2*a* and 2*b* (simultaneously the stop parts 5*a* and 5*b*) can be produced by an injection molding of stop part and a following magnetization of the magnetic body (i.e. application of magnetic force) as shown in FIG. 8. In the process of injection molding, problem otherwise caused when a permanent magnet is used may be avoided if a non-magnetized magnetic body is used. For example, in a case where a non-magnetized magnetic body is used, there is no possibility that it is magnetically attached to a surrounding magnetic parts while being transferred by a chuck or gripper. Also, there is no need to check if a mold is magnetic or not. With respect to the magnetization, it can be carried out by forming a strong magnetic field by electromagnets and placing in the field the stop part with the non-magnetized magnetic body embedded therein.

The injection molding can be carried out through two steps of first and second injection moldings. In the first injection molding, the magnetic bodies 30*a* and 30*b* are placed in molding cavities defined by upper and lower molds 18 and 19 as shown in FIGS. 9 and 10. Preferably, the magnetic body 30*a*,30*b* is sandwiched and held between the lower and upper molds 18 and 19, thus suppressing its displacement. Note that, appropriate clamping pressure is set for sandwiching the magnetic body 30*a*,30*b*.

The first region 31 of the surface (e.g. the main surface 34,35 and the side surface 36) of the magnetic body 30*a*,30*b* is exposed in the molding cavity. The second region 32 of the surface (e.g. the main surface 34,35 and the side surface 36) of the magnetic body 30*a*,30*b* is in contact with the mold surface of the lower mold 18 or the upper mold 19. Molten resin flows into the molding cavity through a gate and in turn, is solidified by cooling the upper and lower molds. In such a way, the first molded part 60*a* (see FIGS. 13-17) and the first molded part 60*b* (see FIGS. 18-21) are obtained. The first resin portion 41*a* adheres to the first region 31. The first resin portion 41*a* does not adhere to the second region 32. The second region 32 remains exposed as not covered by the first resin portion 41*a*.

In the process of the second injection molding, the first molded part 60*a*,60*b* is placed in a molding cavity defined by the upper and lower molds 18 as illustrated in FIGS. 11 and 12. Preferably, the first molded part 60*a*,60*b* is sandwiched and held between the lower mold 18 and the upper mold 19, thus suppressing its displacement. The second region 32 of the surface (e.g. the main surface 34,35 and the side surface 36) of the first molded part 60*a*,60*b* is exposed in the molding cavity. The first resin portion 41*a*,41*b* of the first molded part 60*a*,60*b* is partially in contact with the mold surface of the lower mold 18 or the upper mold 19. This contact surface of the first resin portion 41*a*,41*b* will be the exposed surface of the first resin portion 41*a*,41*b* in the stop part.

Molten resin flows into the molding cavity through a gate and in turn, is solidified by cooling the upper and lower molds. In such a way, the stop part 5*a*, 5*b* (simultaneously the fastener stringer 2*a*,2*b* with the stop part 5*a*,5*b* adhering) is obtained. The second resin portion 42*a*,42*b* adheres to the second region 32. The second resin portion 42*a*,42*b* adheres not only to the magnetic body 30*a*,30*b* but also to the first resin portion 41*a*,41*b*. Note that the side-edge portion of the fastener tape 3*a*,3*b* is also placed in the molding cavity during the second injection molding and as a result of this, the stop part 5*a*,5*b* adheres to the fastener tape 3*a*,3*b*.

With reference to the first molded part 60*a* illustrated in FIGS. 13-17, it would be possible to understand that each of the main surface 34,35 and the side surface 36 of the magnetic body 30*a* is covered by the first resin portion 41*a* and the second resin portion 42*a* in a complemental manner. Furthermore, it would be possible to understand that the first resin portion 41*a* is configured to receive the magnetic body 30*a*, and the second resin portion 42*a* configures a remainder of the stop part 5*a* other than the first resin portion 41*a*.

The first molded part 60*a* has covers 64,65 covering the main surfaces 34,35 of the magnetic body 30*a*, and a plurality of walls 66 covering the side surface 36 of the magnetic body 30*a*. The covers 64 and 65 are interconnected via the plurality of walls 66. The first region 31 is larger than the second region 32 in the main surface 34 of the magnetic body 30*a*. The same applies to the main surface 35 and the side surface 36 of the magnetic body 30*a*. By widening the first region 31 than the second region 32 as such, stability of the first molded part 60*a* on the lower mold 18 during the second injection molding would be enhanced. Note that, the covers 64,65 and the walls 66 adhere to the respective surfaces of the magnetic body 30*a*.

The covers 64 and 65 are provided with grooves 64*a* and 65*a* extending radially inward, respectively. The grooves 64*a* are formed to expose the main surface 34 of the magnetic body 30*a* in its outer peripheral area. The same applies to the grooves 65*a*. The first resin portion 41*a* is formed thinner in the center of the cover 65, allowing the grooves 65 to be in spatial communication (as a result, the Y-shaped groove is formed). Therefore, during the second injection molding, a molten resin can smoothly flow into and through the grooves 65*a*. Longitudinal grooves 66*a* are formed between adjacent walls 66 in the circumferential direction. The longitudinal groove 66*a* and the groove 65*a* are continuous, and a groove is formed which continuously extends over the side surface 36 and the main surface 35 of the magnetic body 30*a*. The longitudinal groove 66*a* is in spatial communication with a slot between interconnecting portions 62 described below, and the molten resin can more freely flow during the second injection molding.

The cover 65 has a center 65*p* and a plurality of extending portions 65*q* extending radially outward from the center 65*p*. The center 65*p* is thinner than the extending portion 65*q*, ensuring that the (three) grooves 65*a* are in spatial communication over the above-described center 65*p*. The extending portion 65*q* becomes wider as extending radially outward, i.e. has a fan-shape. Therefore, the groove 65*a* can extend with a substantially constant width in the radial direction.

The first molded part 60*a* may have an annular flange 61 protruding radially outward relative to the central axis AX1 of the magnetic body 30*a*. The annular flange 61 is connected to an outer rim of the cover 64 via a plurality of interconnecting portions 62. Provision of the annular flange 61 allows the first molded part 60*a* to be stably gripped by a chuck or gripper. The annular flange 61 may impede the flow of molten resin during the second injection molding. Therefore, a groove 63 may be formed at the inner side of the annular flange 61 (e.g. between the annular flange 61 and the cover 64). The molten resin can flow into the longitudinal groove 66*a* via a slot formed between interconnecting portions 62. Note that in illustrated example, the groove 64*a* and the groove 65*a* are arranged in a non-superimposed and complemental manner in the circumferential direction, but should not be limited to this. That is, the groove 64*a* may be positioned between the adjacent grooves 65*a* in the circumferential direction, and vice versa.

With reference to the first molded part 60*b* illustrated in FIGS. 18-21, it would be possible to understand that each of the main surface 34,35 and the side surface 36 of the magnetic body 30*b* is covered by the first resin portion 41*b* and the second resin portion 42*b* in a complemental manner. Furthermore, it would be possible to understand that the first resin portion 41*b* is configured to receive the magnetic body 30*b*, and the second resin portion 42*b* configures a remainder of the stop part 5*b* other than the first resin portion 41*b*.

The descriptions related to the first molded part 60*a* would mostly apply to the first molded part 60*b*, thus overlapping descriptions would be omitted. For example, features that the first region 31 is larger than the second region 32; the cover 64,65 is provided with grooves extending radially inward; and the cover 65 has a center 65*p* and a plurality of extending portions 65*q* would be not limited to the first molded part 60*a* but would similarly apply to the first molded part 60*b*. However, unlike the first molded part 60*a*, the cover 64 is shaped in a radial pattern and the widths of the extending portions 65*q* are substantially constant in first molded part 60*b*.

The cover 64 has a center 64*p* and a plurality of extending portions 64*q* extending radially outward from the center 64*p*. The center 64*p* is formed to be not thinner than the extending portion 64*q*, and a spatial communication of the (three) grooves 64*b* is interrupted by the center 64*p*. The extending portions 64*q* extend radially outward while having a constant width. Therefore, the groove 64*b* between the extending portions 64*q* would be shaped like a fan having a narrower width at radially inward area and having a wider width at radially outward area. The groove 64*b*, the longitudinal groove 66*b* and the groove 65*b* are in spatial communication, forming a groove that extends over the main surface 34, the side surface 36 and the main surface 35 of the magnetic body 30*b*.

The first molded part 60*a*,60*b* is not limited to the illustrated shape, but can be modified to other various shapes.

Method of producing a slide fastener would be appreciated by a skilled person in the art in light of the technical level at the time of filling of this application and the above descriptions, particularly in light of the method of producing the stop parts. Unique improvements in relation to the stop part of the present application would be discussed below.

With respect to a timing of magnetization of the magnetic body 30*a*,30*b* embedded in the stop part, it may preferably done after a slide fastener 1 is assembled from a pair of fastener stringers. The stop parts 5*a* and 5*b* are coupled one another in the slide fastener 1, and the base portion 6*a* and the base portion 6*b* are stacked. Therefore, the magnetic body 30*a* of the base portion 6*a* and the magnetic body 30*b* of the base portion 6*b* are aligned at upper and lower positions with a distance. In this condition, a magnetic field with a constant direction (e.g. a magnetic field in which lines of magnetic force extend along the up-down direction) is applied to the rear end portion of the slide fastener 1. Then, as would be well understood by referring to FIGS. 5 and 6, the lower half of the magnetic body 30*a* would be magnetized to S-pole (first pole) and the upper half of the magnetic body 30*a* would be magnetized to N-pole (second-pole). Similarly, the lower half of the magnetic body 30*b* would be magnetized to S-pole (first pole) and the upper half of the magnetic body 30*b* would be magnetized to N-pole (second-pole). The magnetic bodies 30*a* and 30*b* are prevented from inversely magnetized with respect to the N-pole and S-pole by applying a magnetic field having a constant direction to the rear end portion of the slide fastener 1 in the assembled state.

Note that the magnetic bodies 30*a* and 30*b* not yet magnetized have been referred to as non-magnetized magnetic bodies, but slightly magnetized magnetic bodies could be used. The non-magnetized magnetic bodies 30*a* and should not be limited to ones causing no magnetic field at all, but could be ones causing a magnetic field with small magnetic flux density.

Based on the above teachings, a skilled person in the art would be able to add various modifications to the respective embodiments. Reference codes in Claims are just for reference and should not be referred for the purpose of narrowly construing the scope of claims.

REFERENCE CODES

1 Slide fastener
2*a*,2*b* Fastener stringer
3*a*,3*b* Fastener tape
4*a*,4*b* Fastener element
5*a*,5*b* Stop part
6*a*,6*b* Base portion
7*a*,7*b* Insert
30*a*,30*b* Magnetic body (the permanent magnet)
41*a*,41*b* First resin portion
42*a*,42*b* Second resin portion
31 First region
32 Second region
34,35 Main surface
36 Side surface

The invention claimed is:

1. A fastener stringer comprising:
a fastener tape provided with a fastener element; and
a stop part adhering to the fastener tape at a position adjacent to the fastener element, wherein
the stop part includes a magnetic body and a resin-made base portion in which an entirety of the magnetic body is embedded,
the base portion consists of first and second resin portions, which adhere to one another and to the magnetic body, and are distinguishable based on an interface formed between the first and second resin portions, and
the magnetic body includes one surface sectioned into separate first and second regions, and the first and second resin portions are arranged to cover and adhere to the first and second regions, respectively.

2. The fastener stringer of claim 1, wherein the one surface of the magnetic body is covered by the first and second resin portions in a complemental manner.

3. The fastener stringer of claim 2, wherein the first and second regions are covered and adhered by the first and second resin portions respectively without interspace therebetween.

4. The fastener stringer of claim 3, wherein the first resin portion has one or more exposed surfaces exposed as not covered by the second resin portion.

5. The fastener stringer of claim 4, wherein a stack portion of the first and second resin portions is provided on a magnetic axis or a central axis of the magnetic body.

6. The fastener stringer of claim 1, wherein each surface of the magnetic body is sectioned into the separate first and second regions which are covered by the first and second resin portions respectively.

7. The fastener stringer of claim 1, wherein the first resin portion has one or more exposed surfaces exposed as not covered by the second resin portion.

8. The fastener stringer of claim 7, wherein the magnetic body comprises first and second main surfaces and a side surface, the first and second main surfaces defining a thickness of the magnetic body, and the one or more exposed surfaces formed over the first main surface of the magnetic body.

9. The fastener stringer of claim 1, wherein the second resin portion has a Y-shaped exposed surface.

10. The fastener stringer of claim 1, wherein a stack portion of the first and second resin portions is provided on a central axis of the magnetic body.

11. The fastener stringer of claim 1, wherein the base portion has an axial protrusion in which the magnetic body is embedded, and the axial protrusion has a flat top surface consisting of exposed surfaces of the first and second resin portions.

12. The fastener stringer of claim 1, wherein the base portion has an axial protrusion in which the magnetic body is embedded, and a side wall of the axial protrusion consists of alternate arrangement of a wall of the first resin portion and a wall of the second resin portion in a circumferential direction.

13. The fastener stringer of claim 1, wherein the base portion has a recess having a bottom surface with the magnetic body arranged directly beneath the bottom surface, and the bottom surface of the recess consists of exposed surfaces of the first and second resin portions.

14. The fastener stringer of claim 1, wherein the first resin portion is formed so as to form one or more grooves through which the magnetic body is exposed, and the second resin portion configures a remainder of the stop part other than the first resin portion with filling the one or more grooves.

15. The fastener stringer of claim 1, wherein the magnetic body is a permanent magnet having first and second main surfaces arranged to cross a magnetic axis of the magnetic body and a side surface connecting outer rims of the first and second main surfaces, said one surface being one of the first and second main surfaces or being the side surface.

16. The fastener stringer of claim 1, wherein the stop part has an insert extending toward the fastener element from the base portion, and the insert is configured to be inserted into an inside of a slider through a rear mouth of the slider or is configured to be inserted into the inside of the slider through an interspace between flanges of top and lower wings of the slider.

17. A slide fastener comprising:

a pair of fastener stringers; and a slider movable to open and close the pair of fastener stringers, wherein each of the pair of fastener stringers is the fastener stringer of claim 1 in which a permanent magnet is provided as the magnetic body, a pair of stop parts in the pair of fastener stringers include the permanent magnets so as to be magnetically attracted to each other to cause a stack of the pair of stop parts, one of the pair of stop parts has a sloped surface that is sloped as extending along a circumferential direction with respect to a magnetic axis of the permanent magnet, and the other one of the pair of stop parts has a sliding portion that slides on the sloped surface in accordance with a magnetic attraction between the permanent magnets of the pair of stop parts.

18. A method of producing the fastener stringer of claim 1, the method comprising:

performing an injection molding to produce the stop part in which the magnetic body is embedded, said injection molding including at least initial and following injection moldings, the first region of the one surface of the magnetic body being covered and adhered by the first resin portion during the initial injection molding, and the second region of the one surface of the magnetic body is covered and adhered by the second resin portion during the following injection molding; and applying a magnetic field to the stop part to magnetize the magnetic body after said injection molding.

19. The fastener stringer of claim 1, wherein a segment of the second resin portion is interposed between segments of the first resin portion on said one surface of the magnetic body, said segment of the second resin portion adhering to the second region, and said segments of the first resin portions each adhering to the first region.

* * * * *